United States Patent [19]

de Loisy

[11] 4,080,523

[45] Mar. 21, 1978

[54] PRESS-BUTTON CONTROLLED ELECTRIC SWITCH

[75] Inventor: Maurice de Loisy, Paris, France

[73] Assignee: Etablissements TORRIX, Levaldois-Perret, France

[21] Appl. No.: 651,238

[22] Filed: Jan. 22, 1976

[30] Foreign Application Priority Data

Jan. 23, 1975 France ..... 75 02051

[51] Int. Cl.[2] ..... H01H 9/16

[52] U.S. Cl. ..... 200/314; 200/153 J; 200/159 A; 200/311

[58] Field of Search ..... 200/159 R, 159 A, 314, 200/340, 153 J, 311

[56] References Cited

U.S. PATENT DOCUMENTS

| | | | |
|---|---|---|---|
| 3,187,602 | 6/1965 | Cousins | 200/153 J X |
| 3,378,663 | 4/1968 | Abramowitz | 200/340 X |
| 3,707,610 | 12/1972 | Davies | 200/153 J |
| 3,766,346 | 10/1973 | Alexander | 200/153 J |
| 3,805,004 | 4/1974 | Kondo | 200/311 |
| 3,965,320 | 6/1976 | Ditzig | 200/314 |

*Primary Examiner*—J. V. Truhe
*Assistant Examiner*—D. A. Tone
*Attorney, Agent, or Firm*—Diller, Brown, Ramik & Wight

[57] ABSTRACT

In an electric switch of the kind which comprises in a body a connection means rigidly fastened to a pushbutton and mounted for axial movement for electrical connection to two terminals, and a catch pin mounted for movement transversely in the body for co-operation with a heart cam rigidly fastened to the connection means, the catch pin passes entirely through the wall of the body and from the outside of the body is subjected to the action of resilient means which permanently urge the catch pin into contact with the heart cam.

21 Claims, 8 Drawing Figures

PRESS-BUTTON CONTROLLED ELECTRIC SWITCH

BACKGROUND OF THE INVENTION

This invention relates to an electric push-button switch of the kind comprising, in a hollow body carrying two contact terminals normally insulated from one another, a connection means controlled by a push-button and mounted for axial movement in the body between a disconnected position of rest, in which the connection means is at a distance from the contact terminals, and a connected working position in which the connection means is in contact with each of the contact terminals and makes an electrical connection between them; resilient return means urging the connection means in the direction of its position of rest, and cam means disposed between the body and the connection means for the purpose of determining the position of rest and the working position of the connection means and the controlled movement of the connection means from one of these positions to the other, the said cam means comprising a catch pin and a guide plate adapted to co-operate with the catch pin and carrying, on the one hand, two axially spaced retaining notches and, on the other hand, two oblique displacement paths on the axis of movement of the connection means in the body, for the directed passage of the catch pin from one of the said retaining notches to the other.

It relates more particularly, but not exclusively, to electric switches of this kind which, being intended to equip the instrument panels of automobile vehicles for the controlled operation of any accessory at the disposal of the driver, have to be individually provided with two distinct lighting means, namely a first relatively low power lighting means brought into operation as soon as natural lighting becomes insufficient and the driver of the vehicle lights up the side lights of the latter, this first lighting means serving for the individual location of the various switches provided on the instrument panel of the vehicle, and a second lighting means brought into operation only when the accessory controlled by a switch of the said kind is actually in operation, for the purpose of the controlled location of those accessories which have thus actually been brought into operation.

In a general way, in electric switches of this kind, the catch pin or stud permitting the securing of the position of rest and working position of the connection means by co-operation with a guide plate forming a cam, generally of the heartcam type, is mounted for free movement in a channel.

Consequently, depending on the direction imparted to a switch of this kind, the aforesaid catch pin or stud is adapted to fall to the bottom of the channel in which it is disposed, when this channel becomes vertical.

As a result, during the manipulations to which a switch of this kind is subjected when being packed and/or fitted in its position of use, the catch pin or stud may be incorrectly positioned in relation to the guide plate with which it is associated, thus leading subsequently to defective operation of the unit.

Furthermore, in cases where, as indicated above, it is necessary to equip a switch of this kind with two separate lighting systems, the two lighting systems are generally provided by a single lamp with which there are associated two supply circuits of different resistivities, of which one, having the higher resistivity, is systematically operated when the driver of the vehicle lights up the lights of the vehicle, and the other, which has lower resistivity, is operated only when the accessory controlled by the switch in question is actually operated.

Because of its nature, this arrangement nevertheless requires the use of two different resistive circuits and is therefore relatively expensive.

Furthermore, although it actually makes it possible to distinguish between the two lighting systems proposed, this distinction is made only through the different intensities of the lighting systems and not, as may be desirable, by different colorations of the lighting systems.

It is an object of the present invention to overcome these difficulties.

More precisely, it is an object to provide an electric push-button switch of the kind first mentioned above which has great operating reliability and is capable of being equipped with means making it possible to provide two lighting systems which are distinct both in respect of intensity and in respect of coloration.

According to the invention there is provided an electric push-button switch of the kind first described above wherein the guide plate is rigidly fastened to the connection means and the catch pin which co-operates therewith forms an independent element which passes entirely through the wall of the body situated opposite the guide plate carried by the connection means, with the aid of a hole provided for the purpose in the said wall, and wherein the independent element is subjected to the action of resilient means urging it in the direction of the guide plate with which it cooperates.

In this way the catch pin is permanently held in the correct position by friction against the guide plate with which it cooperates.

It has already been proposed to subject a catch pin of this kind to the action of resilient means.

However, in arrangements proposed hitherto in this respect a catch pin of this kind is not mounted for movement in a hole; these known arrangements relate simply to a pin mounted for swivel-joint rocking on the spot, and the resilient means associated with it simply serve to return it to a middle position of rest.

In the arrangement according to the present invention the resilient means should not offer resistance to the displacement of the catch pin, on which it acts, along the hole in which the pin is disposed.

At the end of the body opposite to that where the push-button is disposed the body of the switch may be formed by a removable end carrying, around a lamp support, a tubular case extending substantially axially in the body in the direction of the push-button, and at least a part of the body may be provided with portions permitting the passage of light, which are for example formed by transparent or at least translucent zones of the wall of the body and/or by apertures provided for that purpose in the said wall.

When the body of the switch has portions permitting the passage of light, it permits the transmission in the direction of the push-button of the ambient light in which it is itself situated, this ambient light being brought into action, as is usual per se, as soon as the lights of the vehicle fitted with the switch are lit up.

When the accessory controlled by the electric switch is actually in operation the lamp with which the switch is equipped is in turn lit up and its own illumination is superimposed on that resulting from the ambient illumination.

The two corresponding illuminations are therefore distinguished in intensity; they may in addition have different colorations, for which purpose a coloured screen may advantageously be carried by the tubular casing surrounding the lamp holder.

The tubular casing is preferably, but not necessarily, opaque so that when the lamp surrounding it is illuminated the lighting of the lamp does not interfere unduly with the ambient light and therefore does not modify the latter.

Furthermore, when it is opaque in this manner the tubular case advantageously channels in the direction of the push-button the illumination provided by the lamp which it surrounds, thus preventing the dispersion of this lighting which might attenuate its intensity at the practical level of the push-button.

However, this may be, and in accordance with arrangements known per se, both of the two illuminations provided for the electric switch of the invention can, for example, act in practice either through the actual push-button controlling the switch, for which purpose the push-button is made at least partly translucent, or around the push-button, for which purpose the body of the switch is itself provided with a translucent annular zone around the push-button.

DESCRIPTION OF THE PREFERRED EMBODIMENTS

Figure 1:
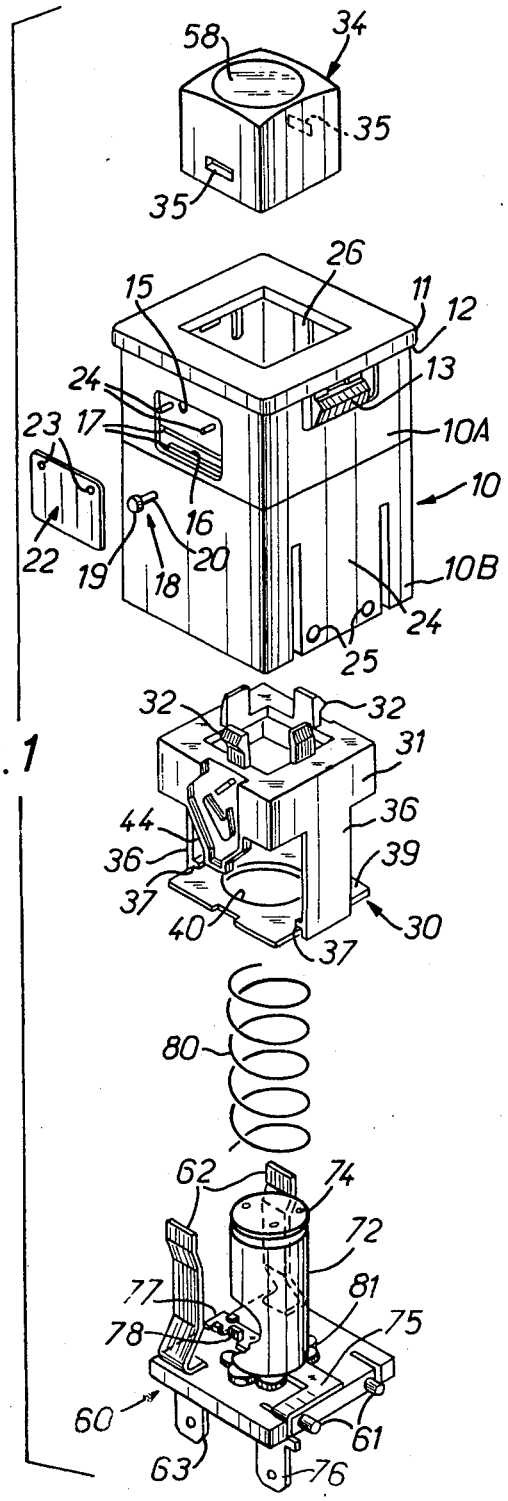
FIG. 1 is an exploded view in perspective, an in part broken away, of an electric push-button switch according to the invention.

The body 10 is open at both ends.

At one end, which is its front end, the body has projecting externally a rim 11 of which a bottom face forms a support shoulder 12 adapted to limit the engagement of the body 10 when the latter is inserted into a complementary socket intended to receive it.

On two opposite sides the body 10 carries, under and near the rim 11, two resiliently deformable members 13 which project laterally and which in known manner are intended to permit the click or snap-in engagement of the body in the complementary socket.

In known manner the members 13 form an integral part of the body 10 and are made in one piece with it.

On another of its sides the body 10 has a generally quadrangular recess 15 bordered at the bottom by a catch pin-receiving hole 16 which extends substantially transversely in relation to the axis of the body 10 and which passes right through the wall of the body.

In practice the hole 16 is flanked on both sides by support shoulders 17 which serve to retain a catch pin 18 which for this purpose has a head 19 whose diameter is greater than the width of the hole 16.

The stem 20 of the catch pin forms a catch stud which projects into the body 10.

Inside the recess 15, and therefore outside the body 10, there is placed a resiliently deformable plate 22 which is fixed by one of its edges to the body 10 in such a manner that its opposite edge, which is free, covers the hole 16 provided in the body 10.

In the example illustrated, the plate 22 is provided with two holes 23 for fastening purposes and it is engaged by these holes on pins 24 projecting from the body 10 at the bottom of the recess 15, the pins 24 being made integrally with the body 10.

After the plate 22 has been engaged on the pins 24, the latter are burred, as illustrated, thus achieving the desired fastening of the plate 22.

The catch pin 18 is made sufficiently long to enable its head 19 to project, in all circumstances, from the bottom of the recess 15, so that the free edge of the plate 22 covering the hole 16, and therefore covering the head 19 of the catch pin 18, will bear resiliently against the catch pin.

The plate 22 therefore forms for the catch pin 18 resilient means which permanently urge the catch pin in the direction of the interior of the body 10 and therefore of a guide plate with which, as will be described hereinbelow, the catch pin has to cooperate.

At the opposite end to that provided with the rim 11 the body 10 forms, by two of its sides, resiliently deformable legs 24, each of which has two passages 25 near its free edge, for reasons which will be explained hereinbelow.

Figure 2:
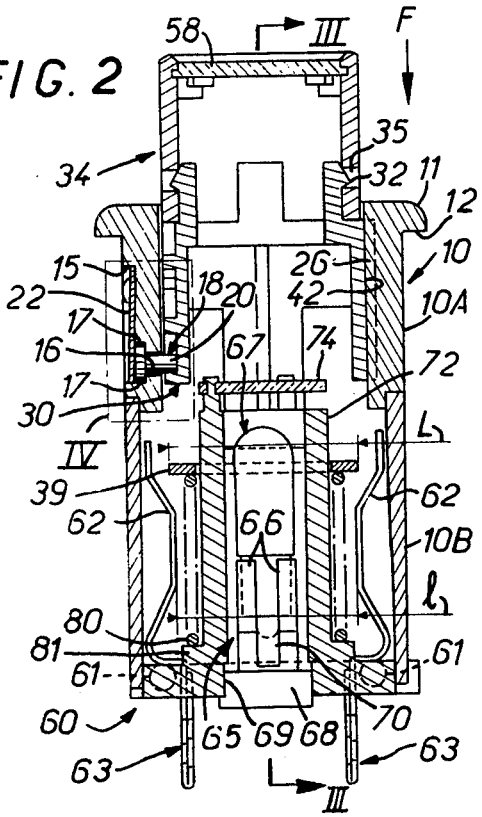
FIG. 2 is a view in axial section of the push-button switch, taken on the line II—II in FIG. 3, showing the "off" position of the switch.

Internally the body 10 has, on at least one of its sides, a projecting guide strip 26, FIG. 2, which extends over a part of the height of that side, starting from the end of the body 10 provided with the peripheral rim 11.

The body 10 may be formed by moulding in any suitable synthetic material.

For preference the body is provided with passages adapted to permit at least the filtering of ambient illumination.

In the example illustrated, the light filtering passages result from the fact that the bottom portion 10B of the body 10, which is rigidly fastened to the top portion 10A of the body carrying the peripheral rim 11, is of transparent or at least translucent synthetic material.

A translucent material of this kind may for example be of the kind sold under the trade name PLEXIGLAS.

In the above described body 10 a connection unit 30 is mounted for axial movement.

In the embodiment illustrated the connection unit comprises a frame 31 of generally rectangular cross-section, which is smaller than that of the body 10.

On its upper face the frame 31 carries two projecting hooks 32 which are resiliently deformable for click engagement of a push-button 34, which for this purpose is provided with two lateral apertures 35 adapted to co-operate with the hooks 32.

The push-button 34 has a generally square cross-section complementary to the free section of the end of the body 10 provided with a peripheral rim 11. It is therefore able to project from this end and to be pushed axially into the latter.

On two opposite sides the frame 31 of the connection unit 30 carries two arms 36 which extend substantially axially oppositely to the hooks 32 and which at their ends are provided, opposite one another, with slots 37 permitting their click engagement on a metal plate 39.

The metal plate 39 thus extends transversely in the body 10 at a distance from the frame 31 carrying it, parallel to the frame 31.

For reasons which will be explained below the plate 39 is provided in its central zone with a substantially circular aperture 40.

Figure 3:
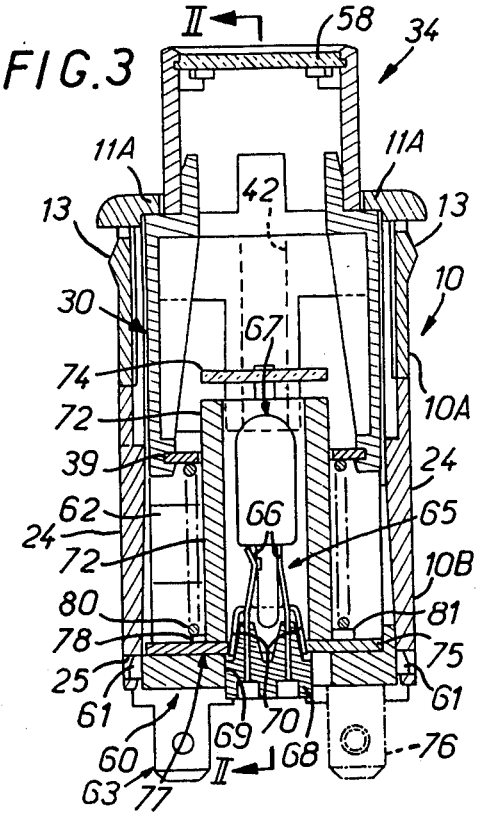
FIG. 3 is another view of the switch in axial section on the line III—III in FIG. 2.
Figure 4:
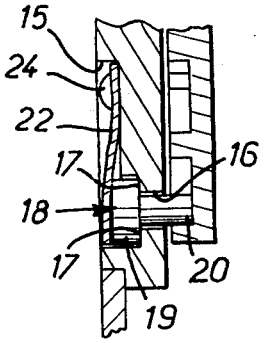
FIG. 4 shows, to an enlarged scale, a detail of FIG. 2 within the inset IV in FIG. 2.
Figure 5:
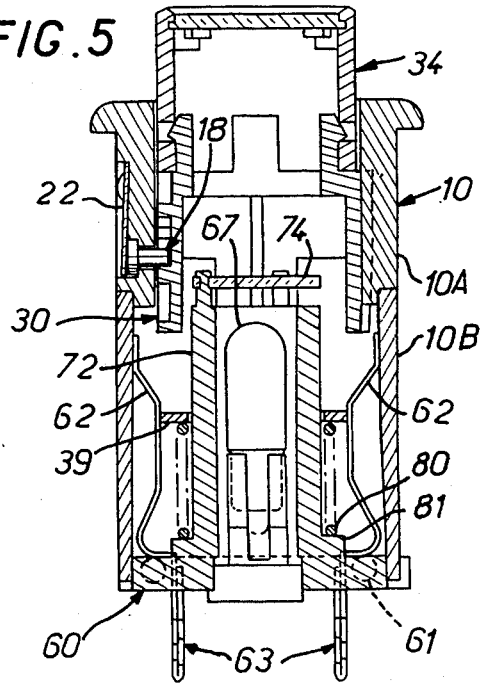
FIG. 5 is a similar view to FIG. 2, showing the "on" position of the switch.
Figure 6:
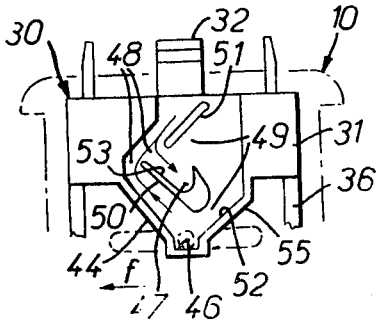
FIGS. 6 and 7 are detail views showing the relative positions of a catch pin provided in the switch, and of a guide plate with which the catch pin cooperates, showing respectively the "off" and "on" positions of the push-button switch of the invention.

On its other two opposite flanks the frame 31 of the connection unit 30 is provided, on the one hand, with a slot 42, FIGS. 2 and 3, which extends substantially axially and which is intended to co-operate, as guide means, with the strip 26 projecting internally from one of the sides of the body 10 (FIG. 2), and on the other hand with a guide plate 44, FIGS. 1 and 6, carrying opposite the free end of the stem 20 of the catch pin 18, cam means of the kind commonly known as heart cams, for co-operation with the catch pin.

In a manner which in general is known per se, the cam means have two retaining notches 46, 47, FIG. 6, spaced axially apart and, on each side, displacement tracks 48, 49 which as a whole are oblique in relation to the axis of the whole arrangement, that is to say in relation to the axis of movement of the connection unit 30 in the body 10.

It is not necessary to describe in detail the retaining notches and the displacement tracks associated with them within the cam means, since cam means of the heart type are well known per se and are sufficiently defined for the specialist by the functions which they have to perform, as will be clear hereinbelow.

It will be sufficient to state that opposite each retaining notch 46, 47 there is provided an oblique disengaging slope 50, 51, sloping in opposite directions to one another, and that with each retaining notch 46, 47 there is associated an oblique engagement slop 52, 53, likewise sloping in opposite directions to one another and sloping oppositely to the inclinations of the corresponding disengagement slope.

These various slopes are formed by the flanks of bosses which project from the guide plate 44 and each of which defines the displacement tracks 48, 49 mentioned above, conjointly with a rim 55 bordering the contour of the guide plate 44 over at least part of the periphery of the guide plate.

In the examples illustrated the push-button 34 intended to be clipped on the connection unit 30 is at least partly translucent; in practice, and as illustrated, the end face of the push-button 34, that is to say the transverse wall of the latter, has its central zone formed by a disc 58 of translucent material.

At its opposite end to that where the push-button 34 is disposed, the body 10 is closed by a removable end 60 carrying two contact terminals with which the connection unit 30 has to cooperate.

In the examples illustrated the end 60 is essentially composed of a simple base whose contour is generally square and is complementary to the corresponding cross-section of the body 10, and on two opposite edges the base carries two projecting pins 61 adapted to co-operate and engage with the apertures or recesses 25 provided for that purpose on the corresponding end of the body 10.

In the examples illustrated the contact terminals carried by the end 60 are composed of two resiliently deformable metal strips 62, both of which are fixed at one end to the base 60 and which extend generally parallel to one another and substantially perpendicularly to the base.

In practice, and as illustrated, the metal strips 62 are formed by the internal extensions of connection pins 63 which project from the base 60 outside the body 10.

Furthermore, the metal strips 62 together form, on the path of the metal plate 39 carried by the connection unit 30, a zone l, FIG. 2, of reduced width, which width is smaller than that of the corresponding dimension L of the metal plate 39 (FIG. 2).

In its central zone the base 60 carries a lamp-holder 65.

In practice, and as illustrated, the lamp-holder 65 is composed of metal strips 66 adapted to come into contact with the supply contact of a lamp 67, and is carried by a base 68 which, in the example illustrated in FIGS. 1 to 7, is simply driven by force into a hole 69 in the base 60.

As will be clear hereinbelow the lamp-holder 65 also comprises metal strips 70 for connection to connection means adapted to supply the lamp 67.

In a manner known per se the metal strips 70 may be composed of a single piece formed from a suitably cut and folded metal blank.

For preference, and as illustrated, the base 60 carries around the lamp-holder 65 a tubular case 72 which extends substantially axially in the body 10 in the direction of the push-button 34.

In practice a tubular case 72 of this kind is made in one piece with the base 60 carrying it.

A tubular case 72 of this kind is preferably opaque.

At its end nearer the push-button 34 the tubular case 72 carries an optical element, which in the example shown in FIGS. 1 to 7 is a colored screen 74.

As already stated above, connection elements are provided for supplying the lamp 67.

In the example illustrated one of the connection elements is composed by the internal extension 75 of an independent connection pin 76 which projects from the base 60 outside the body 10, parallel to the connection pins 63.

The internal extension 75 of the connection pin 76, which is folded over to come into contact with the inside surface of the base 60, passes radially through the tubular case 72 until it comes into contact with one of the metal strips 70 provided for that purpose in the lamp-holder 65.

The other connection element provided for supplying the lamp 67 is composed of an independent contact 77 clipped on projections 78 provided for that purpose on the inner face of the base 60.

The contact 77 is composed of a simple strip which passes through the tubular case 72 until it comes into contact with the other strip 70 provided for that purpose on the lamp-holder 65, and which outside the tubular case 72 carries a rim 81, in contact with which is disposed a metal spring 80 interposed between the metal plate 39 of the connection element 30 and the base 60 closing the body 10; the spring 80 thus permanently ensures electrical connection between the metal plate 39 of the connection element 30 and the independent contact 77 carried by the base 60.

On the other hand, this spring 80 is not in contact with the internal extension 75 of the connection pin 76; it bears against a rim 81, FIGS. 2 and 3, surrounding the base of the case 72 and interrupted locally for the passage of the independent contact 77 and of the internal extension 75 of the connection pin 75.

As can readily be understood, the spring 80 constitutes a resilient means which is associated with the connection element 30 and permanently urges the latter in the direction of its disconnected position of rest.

In this disconnected position of rest, which is shown in FIGS. 2 and 3, the connection element 30 and the push-button 34 secured to it are retained by co-operation of the catch pin 18 with the retaining notch 46 provided on the guide plate 44 carried by the connection element 30; the catch pin 18 is in practice at the centre of the hole 16 through which it passes.

As a safety measure, and as can be seen in FIG. 3, the connection element 30 may also bear in the disengaged position of rest against two projections 11A provided opposite one another at the end of the body 10 through which the push-button 34 passes, in the interior of the body.

However this may be, in the position of rest the metal plate 39 carried by the connection element 30 is at a distance from the narrowed zone formed by the metal strips 62 constituting the associated contact terminals.

Consequently, the metal plate 39 is not in contact with the strips 62, and the latter are thus insulated from one another.

Similarly, the contact 77 provided for supplying the lamp 67 remains insulated from the connection pins 63, and the lamp 67 is therefore not under voltage.

However, if the body 10 is bathed in ambient lighting, the light reaches the push-button 34 through the fact that the bottom part 10B of the body is at least translucent, and consequently, since the push-button 34 also has a translucent disc 58, the ambient light is visible from the outside, thus enabling an observer to locate the switch.

If the push-button 34 is pushed in as shown by the arrow F in FIG. 2, the push-button and also the connection unit 30 attached to it will move axially in the body 10 against the action of the return spring 80.

From the commencement of this driving-in movement the retaining notch 46 moves away from the catch pin 18 and the latter, guided by the displacement slopes provided for that purpose on the guide plate 44, first moves tranversely to one of the ends of the hole 16 in which it is movable, in the direction of the arrow *f* in FIG. 6, and then returns to its central starting position in the hole 16 by a displacement in the opposite direction to that indicated by the arrow *f*, but during this reciprocating movement of the catch pin 18 the retaining notch 47 has now taken up a position in line with the catch pin 18, so that if at that moment the driving-in action applied to the push-button 34 is released the retaining notch 47 of the guide plate 44 is engaged by the catch pin 18, after a momentary oblique displacement of the latter enabling the engagement slope 53 associated with the retaining notch 47 to be interposed on its path, through the action of the return spring 80.

The path followed by the catch pin 18 in relation to the guide plate 34 with which it co-operates is indicated diagrammatically by arrows in FIG. 6.

In the "on" position thus reached by the connection unit 30, the metal plate 39 carried by the unit 30 is situated in the zone of reduced width formed by the metal strips 62, and each of these strips is therefore resiliently in contact with the corresponding edge of the plate 39.

The strips 62 are consequently electrically connected together by the metal plate 39 of the connection unit 30, thus enabling the accessory controlled by the switch constructed in this manner to be supplied with current.

At the same time the spring 80 establishes electrical connection between the connection pins 63 and the contact 77, so that from the pins 63 to the independent connection pin 76 a continuous circuit is re-established which supplies the lamp 67, which consequently lights up.

The coloured screen 74 makes it possible to give a particular coloration to the lighting supplied by the lamp, so that this light can be distinguished from the ambient light.

The tubular case 72 surrounding the lamp 67 makes it possible to minimize the loss of light and to prevent the light provided by the lamp 67 from interfering with the ambient light.

If the push-button 34 is now pushed in again, the displacement slope 51 associated with the retaining notch 47 of the guide plate 44 directs the catch pin 18 towards the opposite end of the hole 16, to that towards which the catch pin was guided during the preceding movement, so that when this driving-in action is in turn released the retaining notch 46 is able once again to come into engagement with the catch pin 18 through the action of the return spring 80.

Figure 7:
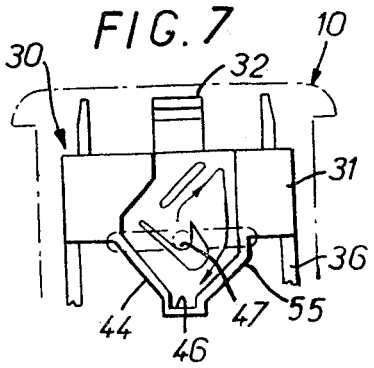

The corresponding path followed by the catch pin in relation to the guide plate 44 with which it co-operates is indicated diagrammatically by arrows in FIG. 7.

In all cases the metal plate 22, which bears against the head 19 of the catch pin 18, resiliently urges the latter in the direction of the guide plate 44 with which it co-operates, so that through friction in contact with the guide plate the catch pin 18 is prevented from moving freely in the hole 16, this friction nevertheless not being sufficient to prevent the displacement of the catch pin 18 in the hole 16 when this displacement is imposed on the catch pin by the guide plate 44, as described above.

Figure 8:
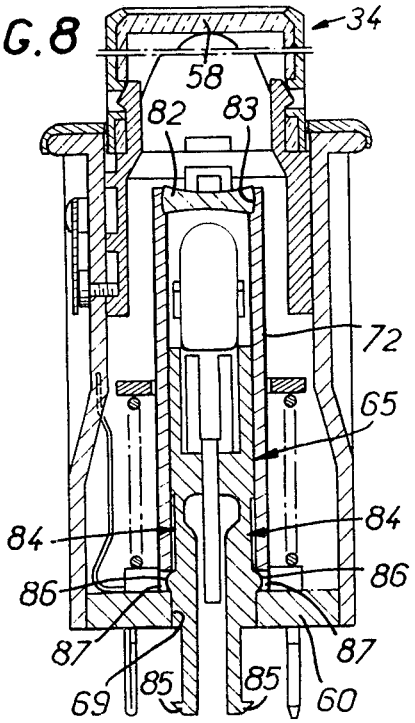
FIG. 8 is a view in axial section of a modified embodiment.

In the modified embodiment illustrated in FIG. 8, the optical element carried by the case 72 is a bioconcave lens 82 which assists the obtaining of a better light output at the disc 58 closing the push-button 34; for the same purpose the lamp-holder 65 is lengthened axially so that the lamp 67 will be situated as close as possible to the push-button.

Like the screen 74 referred to above, the lens 82 may also be colored.

However this may be, a lens of this kind is simply driven by force into a recess 83 provided for the purpose at the free end of the case 72, and it is placed in this recess by resilient deformation of the said end; as illustrated, in order to achieve better retention of the lens the periphery of the lens 82 and the bottom of the recess 83 have complementary cross-sections which are respectively convex and concave.

In this embodiment illustrated in FIG. 8, the lamp holder 65 is removable. For this purpose it is extended by two resiliently deformable legs 84 which form gripping means 85, beyond the base 60, in the bore 69 of which it is engaged.

The legs 84 are provided with lateral bosses 86 adapted to co-operate by engagement with recesses 87 provided for the purpose in the base of the case 72; the complementary engagement means thus formed can, if desired, be transposed between the case 72 and the lamp holder 65.

However this may be, it is sufficient to move the legs 84 towards one another in order to disengage the engagement means and to make it possible to withdraw the lamp holder 65.

I claim:

1. An electric push-button switch of the kind comprising, in a hollow body carrying two contact terminals normally insulated from one another, a connection means controlled by a push-button and mounted for axial movement in the body between a disconnected position of rest, in which the connection means is at a distance from the contact terminals, and a connected working position in which the connection means is in contact with each of the contact terminals and makes an electrical connection between them; resilient return means urging the connection means in the direction of its position of rest, and cam means disposed between the body and the connection means for the purpose of determining the position of rest and the working position of the connection means and the controlled movement of the connection means from one of these positions to the other, the said cam means comprising a catch pin and a guide plate adapted to co-operate with the catch pin and carrying, on the one hand, two axially spaced retaining notches and, on the other hand, two oblique displacement paths on the axis of movement of the connection means in the body, for the directed passage of the catch pin from one of the retaining notches to the other, wherein the guide plate is rigidly fastened to the connection means and the catch pin which cooperates therewith is carried by said body, said connection means including a metal plate for cooperation with resiliently deformable metal strips forming the associated contact terminals, the said metal strips being fixed at one of their ends to the body and conjointly forming, on the path of the metal plate of the connection element and at a distance from the said end, a zone of reduced width smaller than the corresponding dimension of the metal plate.

2. A switch according to claim 1, wherein the metal strips forming the contact terminals are composed of the internal extension of connection pins which project outside the cylindrical body.

3. A switch according to claim 1, wherein the connection elements comprise on the one hand the internal extension of an independent connection pin and on the other hand an independent contact connected to one of the contact terminals, and wherein the resilient return means urging the connection means in the direction of its position of rest comprises a metal spring interposed between the metal plate carried by the connection means and the base closing the body, said spring permanently making electrical connection between the plate and the independent contact carried by the base.

4. An electric push-button switch of the kind comprising in a hollow body carrying two contact terminals normally insulated from one another, a connection means controlled by a push-button and mounted for axial movement in the body between a disconnected position of rest, in which the connection means is at a distance from the contact terminals, and a connected working position in which the connection means is in contact with each of the contact terminals and makes an electrical connection between them; resilient return means urging the connection means in the direction of its position of rest, and cam means disposed between the body and the connection means for the purpose of determining the position of rest and the working position of the connection means and the controlled movement of the connection means from one of these positions to the other, the said cam means comprising a catch pin and a guide plate adapted to co-operate with the catch pin and carrying, on the one hand, two axially spaced retaining notches and, on the other hand, two oblique displacement paths on the axis of movement of the connection means in the body, for the directed passage of the catch pin from one of the retaining notches to the other, wherein the guide plate is rigidly fastened to the connection means and the catch pin which co-operates therewith is carried by said body, at its opposite end to that where the push-button is disposed said body is closed by a removable base carrying around a lampholder, a tubular case extending substantially axially in the body in the direction of the said push-button, and said lampholder being carried by a base engaged in a bore in the removable base of the body.

5. A switch according to claim 4, wherein the lampholder is removable, being extended by resiliently deformable legs which are extended beyond the base of the body carrying the lamp-holder, so as to form gripping means, and which are provided with engagement means, such as bosses or recesses for cooperating with complementary engagements means, such as recesses or bosses, formed in or on the base.

6. An electric push-button switch of the kind comprising, in a hollow body carrying two contact terminals normally insulated from one another, a connection means controlled by a push-button and mounted for axial movement in the body between a disconnected position of rest, in which the connection means is at a distance from the contact terminals, and a connected working position in which the connection means is in contact with each of the contact terminals and makes an electrical connection between them; resilient return means urging the connection means in the direction of its position of rest, and cam means disposed between the body and the connection means for the purpose of determining the position of rest and the working position of the connection means the controlled movement of the connection means from one of these positions to the other, the said cam means comprising a catch pin and a guide plate adapted to co-operated with the catch pin and carrying, on the one hand, two axially spaced retaining notches and, on the other hand, two oblique displacement paths on the axis of movement of the connection means in the body, for the directed passage of the catch pin from one of the retaining notches to the other, wherein the guide plate is rigidly fastened to the connection means and the catch pin which cooperates therewith is carried by said body, at its opposite end to that where the push-button is disposed said body is closed by a removable base carrying, around a lampholder, a tubular case extending substantially axially in the body in the direction of the said push-button, said lampholder comprises metal strips connected to connection elements adapted to supply a lamp, and said connection elements comprising on the one hand the internal extension of an independent connection pin and on the other hand an independent contact connected to one of the contact terminals.

7. An electric push-button switch comprising a tubular hollow body; a base in the form of an element independent from said body and closing said body; said base carrying at least two resiliently deformable metal contact strips within said body and at least three connection pins outside of said body; connection means between a first of said connection pins and a first of said contact strips; connection means between a second of said connection pins and a second of said contact strips; a push-button controlled connection metal plate mounted for axial movement in said body between a disconnected position of rest in which said connection plate is at a distance from said contact strips and a connected working position in which the connection plate is in contact with said contact strips and makes an electrical connection between said contact strips, said contact strips conjointly forming on the path of the said connection plate a zone of reduced width smaller than the corresponding dimension of said connection plate for engagement by said connection plate; resilient return means urging said connection plate in the direction of its position of rest; cam means disposed between said body and said connection plate for the purpose of determining said position of rest and the said working position of said connection plate and the controlled movement of said connection plate from one of these positions to the other, said cam means comprising a catch means carried by said body and a guide plate rigidly fastened to said connection plate and adapted to cooperate with said catch means, said guide plate having on the one hand two axially spaced retaining notches and on the other hand, two oblique displacement paths on the axis of movement of said connection plate in said body for the directed passage of said catch means from one of said retaining notches to the other; a lampholder carried by said base and provided with two contact means adapted to supply a lamp, said lampholder being engaged in a bore of said base and being removable from said base on the side thereof opposite to said push-button; and two connection elements carried by said base for engagment with said contact means of said lampholder, respectively, one of said connection elements being connected to said connection plate and the other connection element to a third of said connection pins.

8. A switch according to claim 7, wherein said lampholder carries at least one leg projection from said base outside of the hollow body.

9. A switch according to claim 8, wherein said removable lampholder carries two resiliently deformable legs defining gripping means, said legs being provided with engagement means of the boss and recess types for cooperation with complementary engagement means carried by said base.

10. A switch according to claim 7 wherein said metal contact strips are composed of an internal extension of two of said connection pins.

11. A switch according to claim 7, wherein the said connection elements comprise on the one hand the internal extension of one of said connection pins and on the other hand an independent contact connected to the said connection plate.

12. A switch according to claim 7, wherein the said resilient means are formed by a metal spring and said independent contact is connected to said connection plate through said metal spring.

13. A switch according to claim 7, wherein the said base also carries around said lampholder a tubular case extending substantially axially in the body in the direction of said push-button.

14. A switch according to claim 13, wherein the tubular case is opaque.

15. A switch according to claim 13, wherein at its end nearer the push-button said tubular case carries a colored screen.

16. A switch according to claim 13, wherein at its end nearer the push-button said tubular case carries a lens.

17. A switch according to claim 7, wherein the connection plate is clipped to a connection member which carries said guide plate.

18. A switch according to claim 17, wherein said push-button is clipped to said connection element.

19. A switch according to claim 7, wherein the connection plate forms a frame transversally disposed in said body.

20. A switch according to claim 7, wherein at least a part of the body is provided with light passages.

21. A switch according to claim 7, wherein the said base is clipped to the said body.

* * * * *